US007591697B2

(12) United States Patent
Yamada et al.

(10) Patent No.: US 7,591,697 B2
(45) Date of Patent: Sep. 22, 2009

(54) BOAT

(75) Inventors: Takashi Yamada, Shizuoka (JP); Masaru Kawanishi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 33 days.

(21) Appl. No.: 12/108,530

(22) Filed: Apr. 24, 2008

(65) Prior Publication Data

US 2008/0268727 A1 Oct. 30, 2008

(30) Foreign Application Priority Data

Apr. 25, 2007 (JP) ..... 2007-115615

(51) Int. Cl.
*B60L 1/14* (2006.01)

(52) U.S. Cl. ..... 440/2; 440/84

(58) Field of Classification Search ..... 440/1, 440/2, 84; 701/21

See application file for complete search history.

(56) References Cited

U.S. PATENT DOCUMENTS 6,273,771 B1 * 8/2001 Buckley et al. ..... 440/84
7,175,490 B2 2/2007 Kanno et al.
7,524,218 B2 * 4/2009 Okuyama ..... 440/1
2003/0093196 A1 * 5/2003 Okuyama ..... 701/21
2005/0241425 A1 11/2005 Oguma
2007/0273492 A1 * 11/2007 Hara et al. ..... 340/438
2008/0003898 A1 * 1/2008 Watanabe et al. ..... 440/84

* cited by examiner

*Primary Examiner*—Lars A Olson
(74) *Attorney, Agent, or Firm*—Keating & Bennett, LLP

(57) ABSTRACT

An engine ECU provided in a boat propulsion system is connected to a remote control ECU provided in a remote control device, the remote control ECU is connected to a gauge ECU provided in an information display device, and control is performed so as to start communication between the remote control ECU and the gauge ECU after a power supply is turned on and after authentication of the engine ECU and the remote control ECU is completed. Accurate information on the boat propulsion system can be transmitted in response to a request from the information display device at a time of initialization at a system start.

10 Claims, 5 Drawing Sheets

BOAT

BACKGROUND OF THE INVENTION

1. Field of the Invention

The present invention relates to a boat including a boat propulsion system having an engine arranged to provide a propulsive force to the boat, a remote control device arranged to control the boat propulsion system, and an information display device arranged to display information on the boat propulsion system.

2. Description of the Related Art

A conventional boat of this type is described in JP-A-2005-156392. In this boat, an engine ECU for controlling an outboard motor and an information display device (a gauge) for displaying information such as a state of an engine are connected by a cable. Further, information such as the engine rotational speed is transmitted from the engine ECU to be displayed on the gauge.

Specifically, the engine ECU and the gauge transmit and receive an address application at the same time with a system start. After this, communication is started. When a request is made by the gauge, the engine ECU transmits information to the gauge in response to the request, and predefined information (engine rotational speed and the like) is displayed by the gauge.

On the other hand, as another boat of this type, there is a boat described in JP-A-2005-297785.

JP-A-2005-297785 discloses a remote control operation device having a remote control shift lever for performing remote control of forward drive, neutral, and rearward drive; a boat propulsion system having a shift change device for performing shift changes of forward drive, neutral, and rearward drive and a shift actuator for actuating the shift change device; and a control device by which the remote control shift lever is operated in a shift area within a predetermined range from a neutral position and which controls an operation of the shift actuator based on an amount of operation of a remote control shift lever. The control device performs a control operation so as to differentiate an amount of operation of the actuator in relation to an amount of operation of the remote control shift lever within the shift area.

However, when a remote control ECU of a remote control operation device is interposed between a gauge and an engine ECU of a boat propulsion system, reliability is required between the engine ECU and the remote control ECU because it is necessary to exchange information on engine control, while such high reliability is not required between the gauge and the remote control ECU because it is only necessary to exchange information such as engine rotational speed. Accordingly, different transfer systems are used for an information transfer system between the engine ECU and the remote control ECU and an information transfer system between the gauge and the remote control ECU.

Consequently, authentication is performed between the remote control ECU and the engine ECU at the same time as a system start. During the authentication, an initial value (a default value) is transmitted between the remote control ECU and the engine ECU. During the authentication, communication between the gauge and the remote control ECU is performed at the same time as the system start, and a request is made to the remote control ECU by the gauge.

The remote control ECU transmits information to the gauge in response to the request. However, because the authentication is not completed, data transmitted at this time is the default value (an invalid value not usable for control). As a result, the default value is transmitted as engine information from the remote control ECU in response to the request from the gauge.

As described above, accurate information on the boat propulsion system may not be transmitted in response to the request from the gauge during initialization at the system start.

SUMMARY OF THE INVENTION

In order to overcome the problems described above, preferred embodiments of the present invention provide a boat in which accurate information in relation to a boat propulsion system can be transmitted in response to a request from an information display device during initialization at a system start.

A first preferred embodiment of the present invention provides a boat including a boat propulsion system having an engine arranged to provide a propulsive force to the boat, a remote control device arranged to control the boat propulsion system, and an information display device arranged to display information on the boat propulsion system. An engine ECU provided in the boat propulsion system is preferably connected to a remote control ECU provided in the remote control device, the remote control ECU is preferably connected to a gauge ECU provided in the information display device, and a control operation is performed in order to start communication between the remote control ECU and the gauge ECU after a power supply is turned on and after authentication of the engine ECU and the remote control ECU is completed.

According to a second preferred embodiment of the present invention, a time duration after turning on the power supply to completing the authentication is a predetermined time specified in advance, and the control operation is performed so as to start communication between the remote control ECU and the gauge ECU when the predetermined time has passed after turning on the power supply.

According to a third preferred embodiment of the present invention, the control operation is preferably performed by the remote control ECU.

According to a fourth preferred embodiment of the present invention, periodic communication is performed between the engine ECU and the remote control ECU, and a request communication is performed between the remote control ECU and the gauge.

According to a fifth preferred embodiment of the present invention, information on the boat propulsion system is transmitted from the engine ECU to the gauge ECU via the remote control ECU and displayed in the display section by performing a request transmission from the gauge ECU to the remote control ECU after the authentication is completed and after an address application is transmitted from the remote control ECU to the gauge ECU.

According to the various preferred embodiments of the present invention, the engine ECU provided in the boat propulsion system is connected to the remote control ECU provided in the remote control device, the remote control ECU is connected to the gauge ECU provided in the information display device, and the control operation is performed so as to start communication between the remote control ECU and the gauge ECU after the power supply is turned on and after the authentication of the engine ECU and the remote control ECU is completed. Therefore, the information display device can obtain accurate information on the boat propulsion system.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter.

FIG. 1 to FIG. 4 show preferred embodiments of the present invention.

Figure 1:
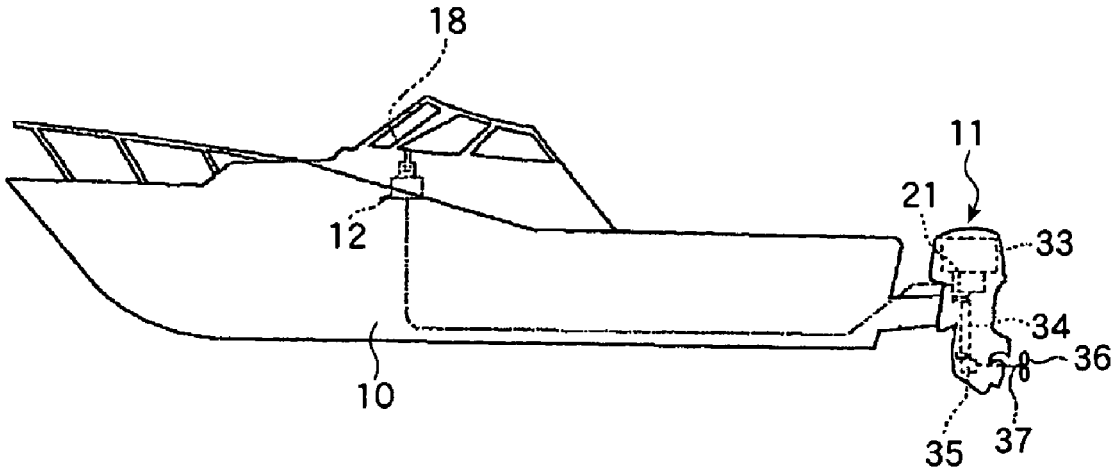
FIG. 1 shows a side view of a boat according to a preferred embodiment of the present invention.
Figure 2:
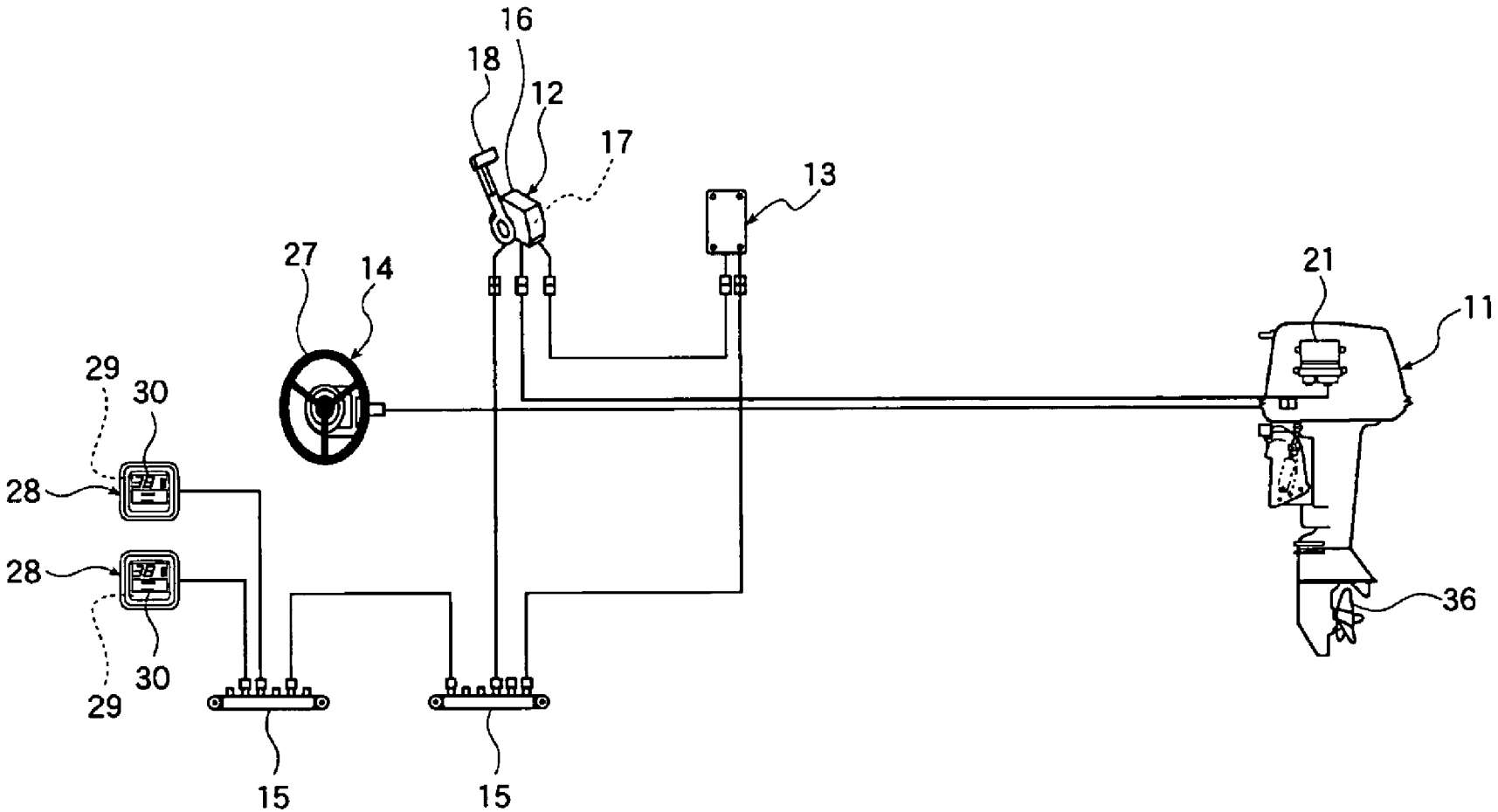
FIG. 2 shows a block diagram illustrating a state of connection of a remote control operation device, a key switch device, an outboard motor, and the like of the boat according to a preferred embodiment of the present invention.

As shown in FIG. 1 and FIG. 2, an outboard motor 11 as an example of a boat propulsion system is attached to a stern of a hull 10 of a boat. The boat is operated by controlling the outboard motor 11 with a remote control operation device 12, a key switch device 13, a steering wheel device 14, and the like disposed around an operator's seat in the hull 10. In addition, a gauge 28 as an example of an information display device for displaying engine information such as engine speed are connected to the remote control operation device 12 via two relay units (hubs) 15. Although two gauges 28 are shown in FIG. 1, only one will be addressed below for simplicity with the understanding that each gauge 28 is capable of performing the operations described below.

The remote control operation device 12 has a remote control ECU 17 contained in a remote control main body 16 and is provided with a remote control shift lever 18 for performing a throttle operation and a shift operation. Remote control of forward drive, neutral, and rearward drive is performed by an operation of the remote control shift lever 18. Operation information on an operation speed and an operation angle of the remote control shift lever 18 is detected by a potentiometer (not shown) and transmitted to the remote control ECU 17.

A signal from the remote control ECU 17 is transmitted to an engine ECU 21 of the outboard motor 11. A drive of a shift motor of a shift actuator (not shown) is controlled based on an amount of operation of the remote control shift lever 18 in the engine ECU 21. A shift change device is actuated by the shift actuator, and a shift change between forward drive, neutral, and rearward drive is performed.

In order to exchange an important signal, the remote control ECU 17 and the engine ECU 21 are connected via a DBWCAN cable as an example of a signal wire, and are in periodic communication with each other. DBW stands for Drive-By-Wire, indicating an operation device which uses an electric connection in place of a mechanical connection, and CAN stands for Controller Area Network.

In addition, as shown in FIG. 2, the key switch device 13 is connected to the remote control ECU 17 of the remote control operation device 12. A start switch, a stop switch, and the like (not shown) are provided on the key switch device 13.

The steering wheel device 14 contains a steering wheel ECU (not shown) and is provided with a steering wheel 27 for performing steering. A position of the steering wheel is detected by a position sensor, and the position sensor is connected to the steering wheel ECU via a signal circuit. Further, the steering wheel ECU of the steering wheel device 14 is connected to the remote control ECU 17 of the remote control operation device 12 via the DBWCAN cable.

The gauge 28 has a gauge ECU 29 connected to the remote control ECU 17, and a display section 30 is connected to the gauge ECU 29. Engine information such as engine speed is displayed in the display section 30 by a signal from the gauge ECU 29. A request for communication is performed between the gauge ECU 29 and the remote control ECU 17.

As described above, the engine ECU 21 is connected to the remote control ECU 17, and the remote control ECU 17 is connected to the gauge ECU 29 by different communication methods.

Control of the remote control ECU 17 is performed so as to start communication between the remote control ECU 17 and the gauge ECU 29 after a power supply is turned on (after a system start), and after authentication of the engine ECU 21 and the remote control ECU 17 is completed.

Specifically, in the present preferred embodiment, the time duration after turning on the power supply (after the system start) to completing the authentication is a predetermined time specified in advance (about two seconds in the present preferred embodiment), and a control operation is performed so as to start communication between the remote control ECU 17 and the gauge ECUs 29 when the predetermined time has passed after turning on the power supply (after the system start). More details of the control operation will be described below.

As shown in FIG. 1, an engine 33 is disposed in the outboard motor 11. An output of the engine 33 is transmitted to a propeller shaft 37 on which a propeller 36 is fixed via a drive shaft 34 and a shift device 35.

A control operation will be described hereinafter.

Figure 3A:
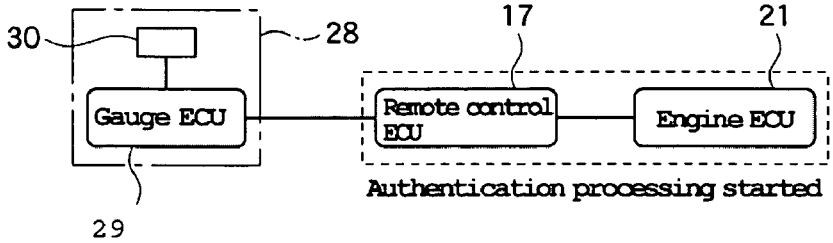
FIGS. 3A-3E show the order of exchange of data between each ECU according to a preferred embodiment of the present invention.

When the key switch device 13 is operated, the power supply is turned on (the main switch is turned on), and the system, such as the outboard motor 11 and the remote control operation device 12, is started. First of all, as shown in FIG. 3A and FIG. 4, authentication processing is started between the engine ECU 21 and the remote control ECU 17.

Figure 3B:
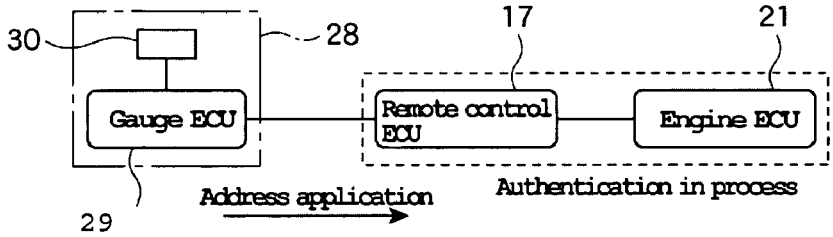
Figure 4:
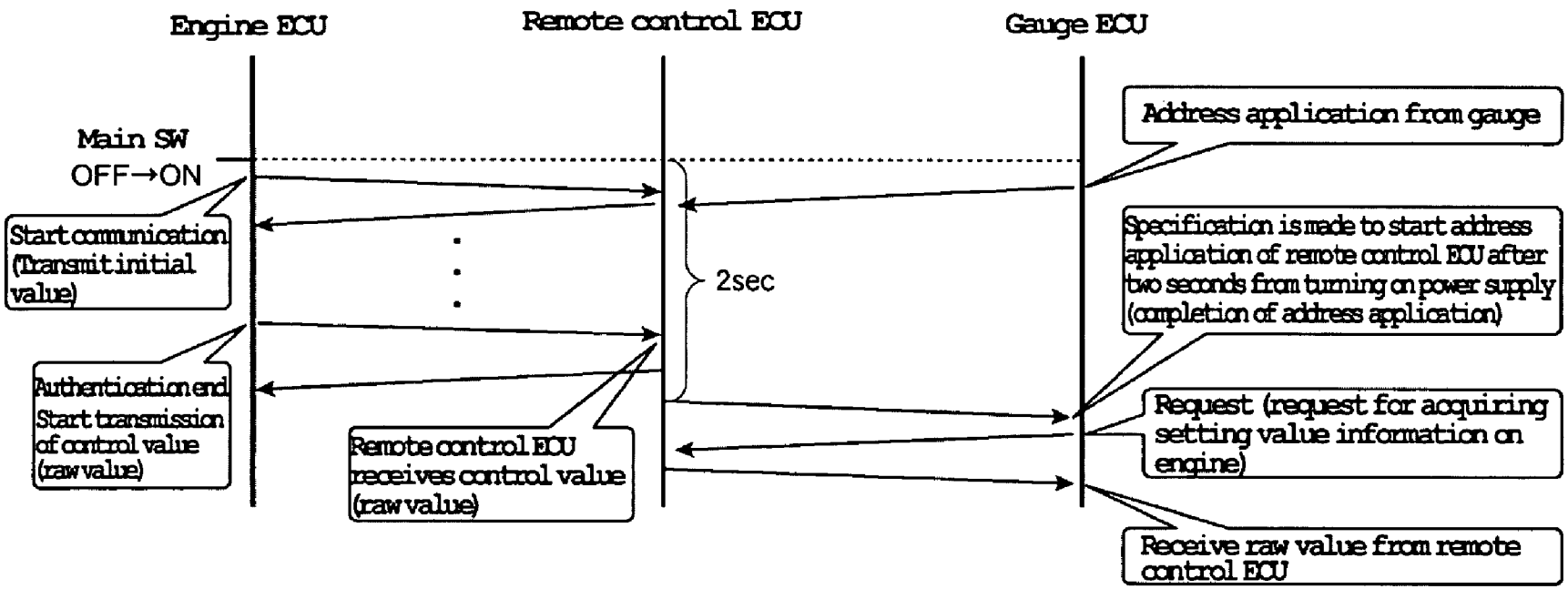
FIG. 4 shows a time chart between each ECU according to a preferred embodiment of the present invention.

Further, as shown in FIG. 3B and FIG. 4, the gauge ECU 29 transmits an address application to the remote control ECU 17. However, the remote control ECU 17 does not transmit the address application to the gauge ECU 29 during authentication or, in other words, until after the authentication processing is completed.

During the authentication, an initial value is transmitted from the engine ECU 21 to the remote control ECU 17 (see FIG. 4).

Figure 3C:
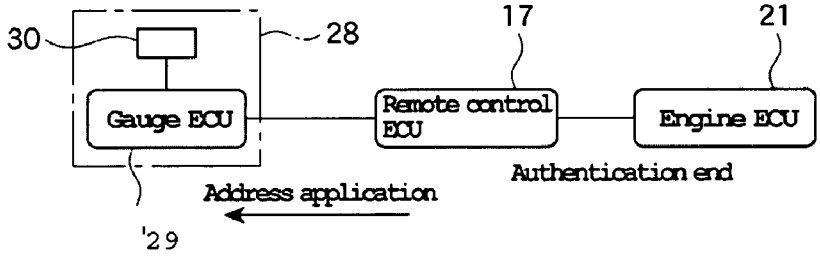

Following this, as shown in FIG. 3C, when the processing of the authentication between the engine ECU 21 and the remote control ECU 17 is completed, communication is started between these ECUs. As shown in FIG. 4, transmission of a control value (a raw value) is started from the engine ECU 21, the control value (the raw value) is received by the remote control ECU 17, and a value in a RAM is overwritten by a latest value. It takes about one second to change the value in the RAM to the latest value.

It takes about two seconds from turning on the power supply to this point in time. After this, the remote control ECU 17 transmits the address application to the gauge ECU 29.

In the present preferred embodiment, the transmission of the address application of the remote control ECU 17 to the gauge ECU 29 is started after about two seconds from turning on the power supply (after a predetermined time passes). As a result, the address application between the remote control ECU 17 and the gauge ECU 29 is finished.

Figure 3D:
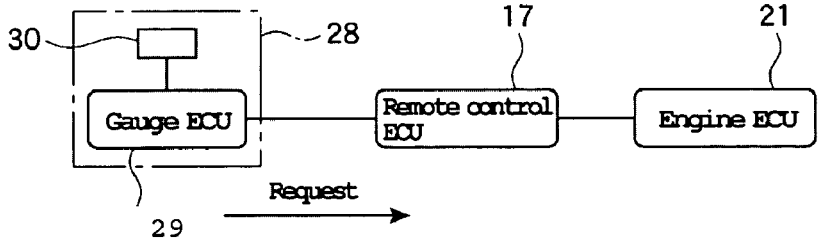

After this, as shown in FIG. 3D, when an address of the remote control ECU 17 is input to the gauge ECU 29, a request communication between these ECUs is started. The gauge ECU 29 makes a request (a request for acquiring information on the engine 33) to the remote control ECU 17.

Figure 3E:
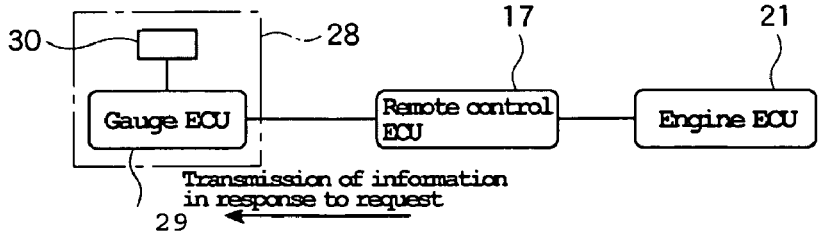

Following this, as shown in FIG. 3E, the remote control ECU 17 can transmit the latest engine information (a raw value) in response to the request, and the gauge ECU 29 receives the information.

Figure 5:
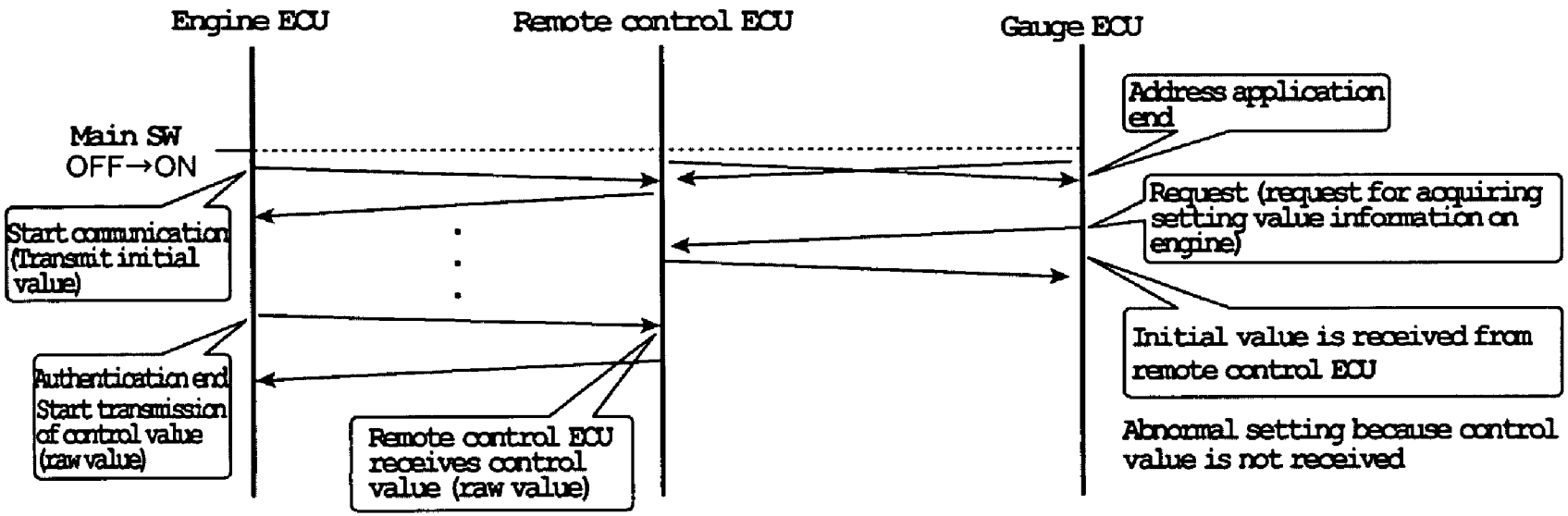
FIG. 5 PRIOR ART
FIG. 5 shows a time chart illustrating a conventional example similar to FIG. 4.

On the other hand, according to a conventional example shown in FIG. 5, after the power supply is turned on, communication is started between the engine ECU and the remote control ECU, and transmission and reception of an address are performed between the remote control ECU and the gauge ECU at the same time with transmission of the initial value as described above.

After authentication is finished between the engine ECU and the remote control ECU, transmission of a control value (a raw value) is started.

However, the transmission and the reception of the address are finished between the remote control ECU and the gauge ECU before that. Therefore, a request is made to the remote control ECU by the gauge ECU. Consequently, because the gauge ECU receives an initial value from the remote control ECU, a control value is not received. As a result, an appropriate display cannot be performed.

In view of this problem, after the authentication between the engine ECU 21 and the remote control ECU 17 is completed, a request is made to the remote control ECU 17 by the gauge ECU 29 as described in above. As a result, the initial value is not received, but the control value (the raw value) is received, and accurate engine information can be displayed in the display section 30.

In a preferred embodiment, the time duration after turning on the power supply (after the system start) to completing the authentication is estimated and is a predetermined time specified in advance (about two seconds in the present preferred embodiment). However, unlike the present preferred embodiment, completion of the authentication may be directly detected, and a request may be made to the remote control ECU by the gauge ECU after that.

In addition, although the outboard motor 11 is used as a boat propulsion system, the present invention is not limited to that, and an inboard-outboard motor or the like may be used.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat comprising:

a boat propulsion system having an engine arranged to provide a propulsive force to the boat;

a remote control device arranged to control the boat propulsion system; and an information display device arranged to display information on the boat propulsion system; wherein an engine ECU provided in the boat propulsion system is connected to a remote control ECU provided in the remote control device;

the remote control ECU is connected to a gauge ECU provided in the information display device; and the remote control ECU and the gauge ECU are arranged to start communication between the remote control ECU and the gauge ECU after a power supply is turned on and after authentication of the engine ECU and the remote control ECU is completed.

2. The boat according to claim 1, wherein a time duration from just after turning on the power supply to completing the authentication is a predetermined time specified in advance, and the remote control ECU and the gauge ECU are arranged to start communication between the remote control ECU and the gauge ECU when the predetermined time has passed after turning on the power supply.

3. The boat according to claim 1, wherein the remote control ECU is arranged to start the communication between the remote control ECU and the gauge ECU.

4. The boat according to claim 1, wherein the engine ECU and the remote control ECU are arranged to be in periodic communication with each other, and the gauge ECU is arranged to request communication between the remote control ECU and the gauge ECU.

5. The boat according to claim 1, wherein the engine ECU is arranged to transmit information on the boat propulsion system to the gauge ECU via the remote control ECU and display the information in the display device by performing a request transmission from the gauge ECU to the remote control ECU after the authentication is completed and after an address application is transmitted from the remote control ECU to the gauge ECU.

6. A method of displaying accurate information in relation to a boat propulsion system at a system start, comprising the steps of:

connecting an engine ECU in the boat propulsion system to a remote control ECU provided in a remote control device;

connecting the remote control ECU to a gauge ECU provided in an information display device for displaying information on the boat propulsion system;

authenticating the engine ECU and the remote control ECU after turning on a power supply; and starting communication between the remote control ECU and the gauge ECU after authenticating the engine ECU and the remote control ECU is completed.

7. The boat according to claim 6, wherein a time duration after turning on the power supply to completing the authentication is a predetermined time specified in advance, and the remote control ECU and the gauge ECU start communicating when the predetermined time has passed after turning on the power supply.

8. The boat according to claim 6, wherein the step of starting communication includes a step of the remote control ECU sending a communication to the gauge ECU.

9. The boat according to claim 6, further comprising the steps of:

the engine ECU periodically communicating with the remote control ECU; and the gauge ECU requesting communication between the remote control ECU and the gauge ECU.

10. The boat according to claim 6, wherein the information on the boat propulsion system is transmitted from the engine ECU to the gauge ECU via the remote control ECU after the authentication is completed and after an address application is transmitted from the remote control ECU to the gauge ECU.

* * * * *